US009421757B2

(12) United States Patent
Egan

(10) Patent No.: US 9,421,757 B2
(45) Date of Patent: Aug. 23, 2016

(54) METHOD AND APPARATUS FOR CLEANING PRINTING PRESSES FOR THREE DIMENSIONAL OBJECTS

(71) Applicant: Ronald G. Egan, Webster, NY (US)

(72) Inventor: Ronald G. Egan, Webster, NY (US)

( * ) Notice: Subject to any disclaimer, the term of this patent is extended or adjusted under 35 U.S.C. 154(b) by 0 days.

(21) Appl. No.: 14/522,373

(22) Filed: Oct. 23, 2014

(65) Prior Publication Data

US 2016/0114573 A1 Apr. 28, 2016

(51) Int. Cl.
*B41F 35/00* (2006.01)

(52) U.S. Cl.
CPC ..... *B41F 35/006* (2013.01)

(58) Field of Classification Search
CPC ..... B41F 35/02
USPC ..... 101/425
See application file for complete search history.

(56) References Cited

U.S. PATENT DOCUMENTS

| | | | | |
|---|---|---|---|---|
| 4,920,880 | A | 5/1990 | Hara | |
| 4,953,252 | A | 9/1990 | Akisawa | |
| 4,981,078 | A * | 1/1991 | Dettinger | B41F 35/006 101/424 |
| 5,322,015 | A | 6/1994 | Gasparrini | |
| 5,367,955 | A | 11/1994 | Hara | |
| 5,373,789 | A | 12/1994 | Waizmann | |
| 5,408,930 | A * | 4/1995 | Loos | B41F 35/00 101/423 |
| 5,440,986 | A * | 8/1995 | Braun | B41F 35/06 101/423 |
| 5,479,857 | A | 1/1996 | Braun | |
| 5,519,914 | A | 5/1996 | Egan | |
| 5,644,986 | A | 7/1997 | Gydesen | |
| 5,727,470 | A | 3/1998 | Kurzer | |
| 5,758,577 | A | 6/1998 | Ebina | |
| 5,842,418 | A | 12/1998 | Corrado | |
| 5,918,545 | A | 7/1999 | Pym | |
| 5,964,007 | A | 10/1999 | Wisniewski | |
| 6,196,128 | B1 * | 3/2001 | Corrado | B08B 7/0028 101/425 |
| 6,640,712 | B2 * | 11/2003 | Corti | B41F 35/00 101/423 |
| 6,645,349 | B1 | 11/2003 | Koivukunnas | |
| 6,679,601 | B1 * | 1/2004 | Pham | B41J 29/17 134/6 |
| 6,694,879 | B2 | 2/2004 | Schuster | |
| 7,011,025 | B2 | 3/2006 | Egan | |

(Continued)

FOREIGN PATENT DOCUMENTS

| | | |
|---|---|---|
| JP | 64-16657 A | 1/1989 |
| JP | 3-90945 U | 9/1991 |

(Continued)

OTHER PUBLICATIONS

Egan, R.G., "Dry Flexographic Printing Plate Cleaner System and Method," U.S. Appl. No. 14/055,787, filed Oct. 16, 2013.

(Continued)

*Primary Examiner* — Anthony Nguyen
(74) *Attorney, Agent, or Firm* — Christensen O'Connor Johnson Kindness PLLC

(57) ABSTRACT

An apparatus and method cleans rollers on printing presses that print indicia on three dimensional objects such as candies, confectionaries and other comestible items. The cleaning apparatus moves in three axes to position itself alternately opposite an engraved roller and a blanket roller. The cleaning apparatus dry cleans one roller and dry and/or wet cleans the other roller. The apparatus has a cleaning pad that extends toward a web of cleaning material to press the cleaning material against a roller. The apparatus moves across the roller to wipe ink and/or debris from the surface of the roller.

18 Claims, 11 Drawing Sheets

(56) References Cited

U.S. PATENT DOCUMENTS

| | | | |
|---|---|---|---|
| 7,754,051 | B2 | 7/2010 | Porco |
| 8,590,449 | B2 | 11/2013 | Egan |
| 2002/0000168 | A1 | 1/2002 | Fuseki |
| 2004/0244618 | A1 | 12/2004 | Egan |
| 2005/0061182 | A1 | 3/2005 | Ebina |
| 2006/0230963 | A1 | 10/2006 | Birger |

FOREIGN PATENT DOCUMENTS

| | | | |
|---|---|---|---|
| JP | 9-76473 | A | 3/1997 |
| JP | 9-295398 | A | 11/1997 |
| JP | 2001-162774 | A | 6/2001 |
| JP | 2001-270087 | A | 10/2001 |
| JP | 2008-062650 | A | 3/2008 |
| WO | 97/00173 | A1 | 1/1997 |
| WO | 97/46388 | A1 | 12/1997 |

OTHER PUBLICATIONS

International Search Report and Written Opinion from corresponding International Patent Application No. PCT/US2010/033813, filed May 6, 2010, 6 pages.

Japanese Patent Office Notice of Rejection, mailed Jan. 21, 2014, issued in corresponding Japanese Patent Application No. 2012-514963, filed May 6, 2010, 8 pages (English summary).

* cited by examiner

METHOD AND APPARATUS FOR CLEANING PRINTING PRESSES FOR THREE DIMENSIONAL OBJECTS

BACKGROUND

Candies, confectionaries, chewing gum, medicines, crackers, cookies, and small manufactured foods are designed small enough so that one or more may be placed in one's mouth for chewing or dissolving or swallowing whole. Such small objects often bear a marking, such as one or more letters and numbers. For example, a fictitious candy identified by a name beginning with the letter "A" may have a soft inner comestible candy enclosed in a relatively hard and rounded candy shell. On the face of the shell, the manufacturer of the candy may print the letter "A" to distinguish the manufacturer's candy from other candies with similar shapes. In a similar manner, medications may carry indicia to identify the manufacturer of the pill, the medication contained in the pill, or both.

Consumers often make judgments on the value of products based upon the packaging or appearance of the products. A consumer will likely notice the indicia on candy or medication. If the indicia are obscured or reflect broken type, the consumer may form an unsatisfactory opinion about the quality of the product or the competence of the manufacturer. Accordingly, manufacturers pay close attention to carefully printing indicia on their products and discard products with obscured, unclear or broken typeface.

Indicia may be obscured during printing by debris from broken objects or excess ink. For example, in an offset printing process, an engraved roller may have a rigid, engraved pattern of indicia that is transferred first to a blanket roller and then to a candy or medicinal tablet or capsule. During an offset printing process the engraved roller passes through an ink bath to ink indicia that appear as a raised surface on the engraved roller. The inked, engraved roller contacts and transfers its inked images to the blanket roller. The blanket roller is has a soft surface for receiving the inked indicia from the engraved roller and transferring the indicia to the candy or tablets. The candies or tablets are held in pockets of a web or other conveyor and carried past the blanket roller. One face of the candy or tablet is turned toward the blanket roller to receive the inked indicia. Those skilled in the art also refer to the blanket roller as the print roller. In either instance, those skilled in the art are referring to a roller with a pliable surface for receiving inked images from the rigid, inked surface of the engraved roller.

Candies, foods, and medicines may come in any one of a number of three dimensional shapes. The simplest shapes are items with opposite flat surfaces spaced from each other by a uniform thickness, in effect, a flat, cylindrical shape. The top and bottom surfaces normally have the same geometric shape which may be any polygon. Other shapes use opposing surfaces with the same curved surface, including and not limited to circles, ovals, and other multi-curved shapes. Such items may be referred to as pills, tablets, lozenges, troches, or capsules.

There are a number of problems encountered in printing indicia on small objects such as candies or pills. The objects are generally fragile and easily breakable. In the normal course of printing, the pressure of the blanket roller against the objects may crack one or more objects and debris from the cracked objects may adhere to the blanket roller and/or transfer to the engraved roller. Such debris will leave an imperfect imprint on one or more objects. Accordingly, manufacturers often must stop the printing process and have a worker clean the blanket roller and the engraved roller.

Cleaning the rollers requires little or no skill. It is normally a manual activity. In a typical cleaning operation, a worker stops the press and uses brushes and cleaning fluid to scrub the ink and debris from the rollers. The blanket roller requires frequent cleaning. During each cleaning, a worker shuts down the offset printing press and cleans the blanket roller. The engraved roller is cleaned less frequently. The cleaning operations are repetitive and boring. Although cleaning the rollers is very important to appearance of the final product, cleaning is often poorly performed. When cleaning is poor, more candies and medicines are rejected at final inspection, thereby reducing productivity and increasing costs of manufacture.

There are known methods and apparatus for cleaning flexographic printing plates. See, for example, prior U.S. Pat. Nos. 7,011,025 and 8,590,449, which are hereby incorporated by reference for all purposes. However, flexographic printing plates have flexible, raised indicia, rather than the hard indicia made of ceramic or steel that is used to print candies and medicines. Likewise, flexographic printing does not require a blanket roller of pliable material.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Embodiments of the apparatus and method disclosed herein overcome one or more problems with the prior art by providing mechanisms and methods that perform one cleaning operation on the blanket roller and another, different cleaning operation on the engraved roller. The embodiments allow the manufacturer to continue to print candies and medicines while the press is running. The method and apparatus performs approximately five to six dry cleaning operations on the blanket roller. After the fifth or more cleanings of the blanket roller, the press stops and the embodiments perform a second, wet cleaning operation on the engraved roller. By providing a single cleaning apparatus that dry cleans the blanket roller during press operation and cleans the engraved roller only once for every five or six dry cleaning operations, the productivity of the manufacturer is enhanced. In addition, the controlled cleaning of the rollers by a machine provides consistent cleaning operations on the blanket roller and on the engraved roller. The overall quality of the cleaning process is improved so that fewer products are rejected for poor quality printing of the indicia.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
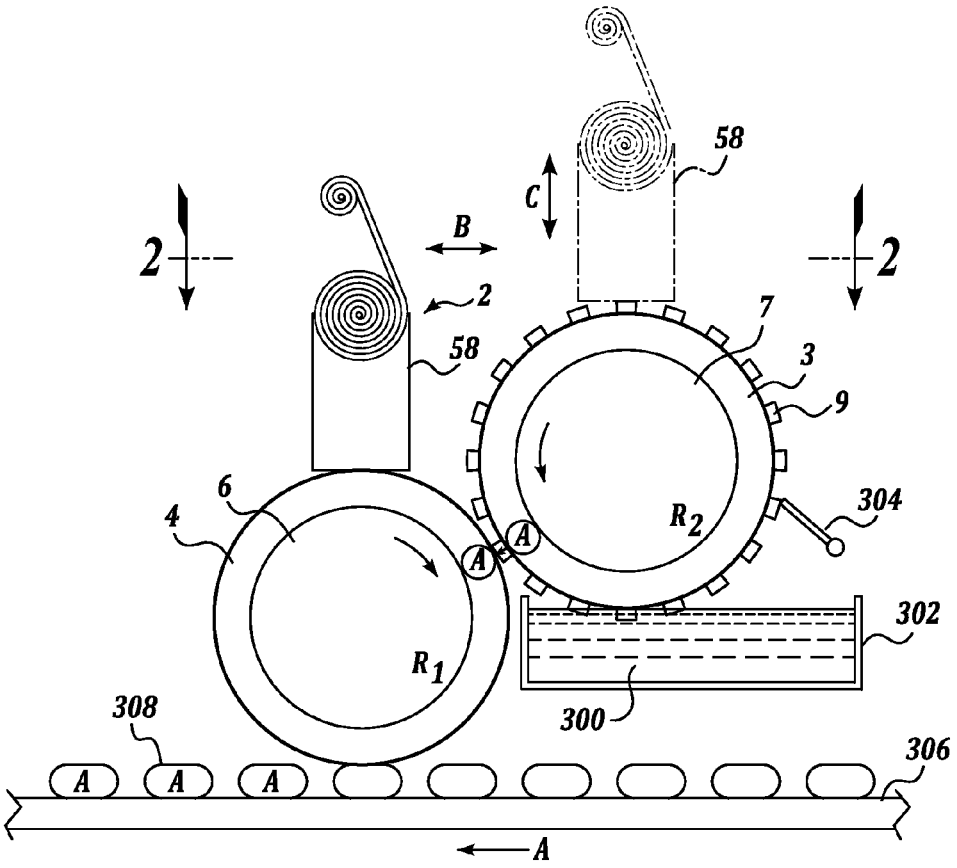
FIG. 1 is a schematic representation of an embodiment of a cleaning apparatus for cleaning engraved and blanket rollers of a printing press.

Referring to FIG. 1, a cleaner 2 is disposed above a blanket roller 4 that is carried on a first support roller 6 that turns in a clockwise direction. The blanket roller 4 is made of a compliant, resilient material, such as rubber. The blanket roller 4 contacts raised indicia 9 on the surface of engraved roller 3 that is carried on second support roller 7. Engraved roller 3 turns in a counterclockwise direction and passes the raised indicia 9 through ink 300 in tank 302. The engraved roller 3 is made of hard, rigid material, such as ceramic or steel. A doctor blade 304 wipes excess ink off the surface of the indicia 9. Ink on the indicia 9 is transferred to the blanket roller 4 to provide an inked image of indicia on the blanket roller 4. The inked image is transferred to objects 308 that are carried by a conveyor or web 306 that travels in the direction of arrow A. Cloth 58 of the cleaner 2 engages the surface of the blanket roller 4 to remove ink and debris. The cloth 58 is a dry, absorbent cloth with a relatively smooth, non-abrasive finish. At a suitable time, cleaner 2 may be moved to the right in one direction of arrow B and up in one direction of arrow C to locate the cleaner 2 adjacent to raised, rigid indicia 9 on the engraved roller 3. After cleaning engraved roller 3, the cleaner 2 is moved down and to the left in the other directions of arrows B and C to position the cloth 58 adjacent the surface of the blanker roller 4.

Figure 2:
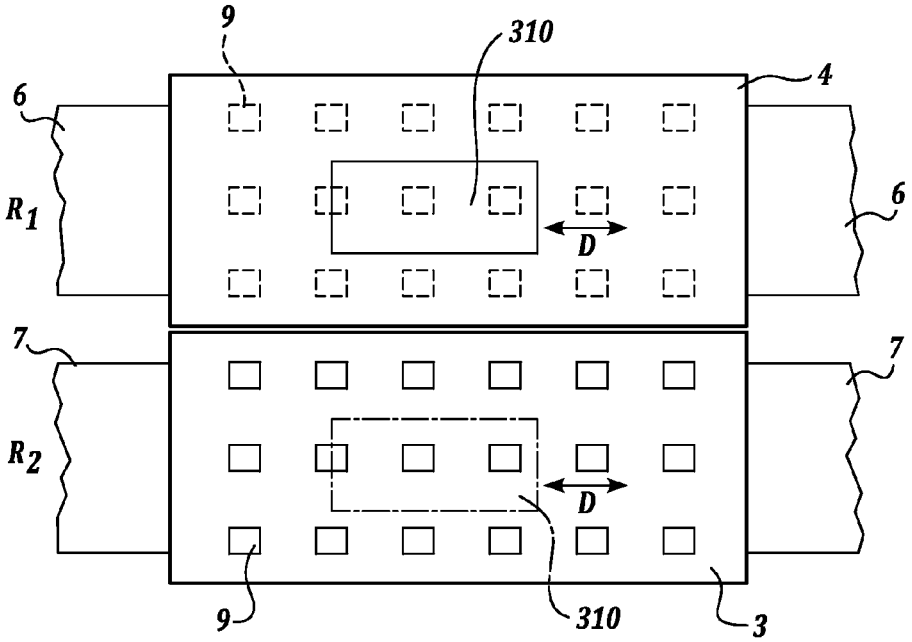
FIG. 2 shows an area of cleaning cloth superimposed on the engraved roller and the blanket roller.
Figure 8:
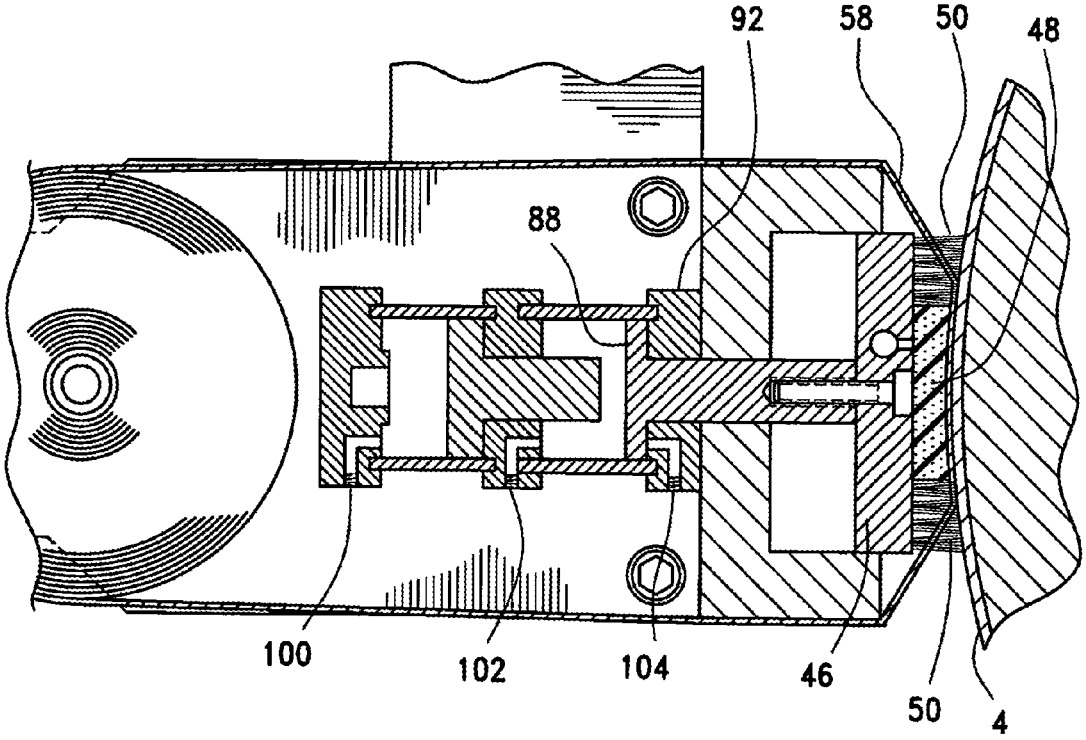
FIG. 8 is similar to FIG. 6, but shows the cylinder extended to its fully extended position.
Figure 9:
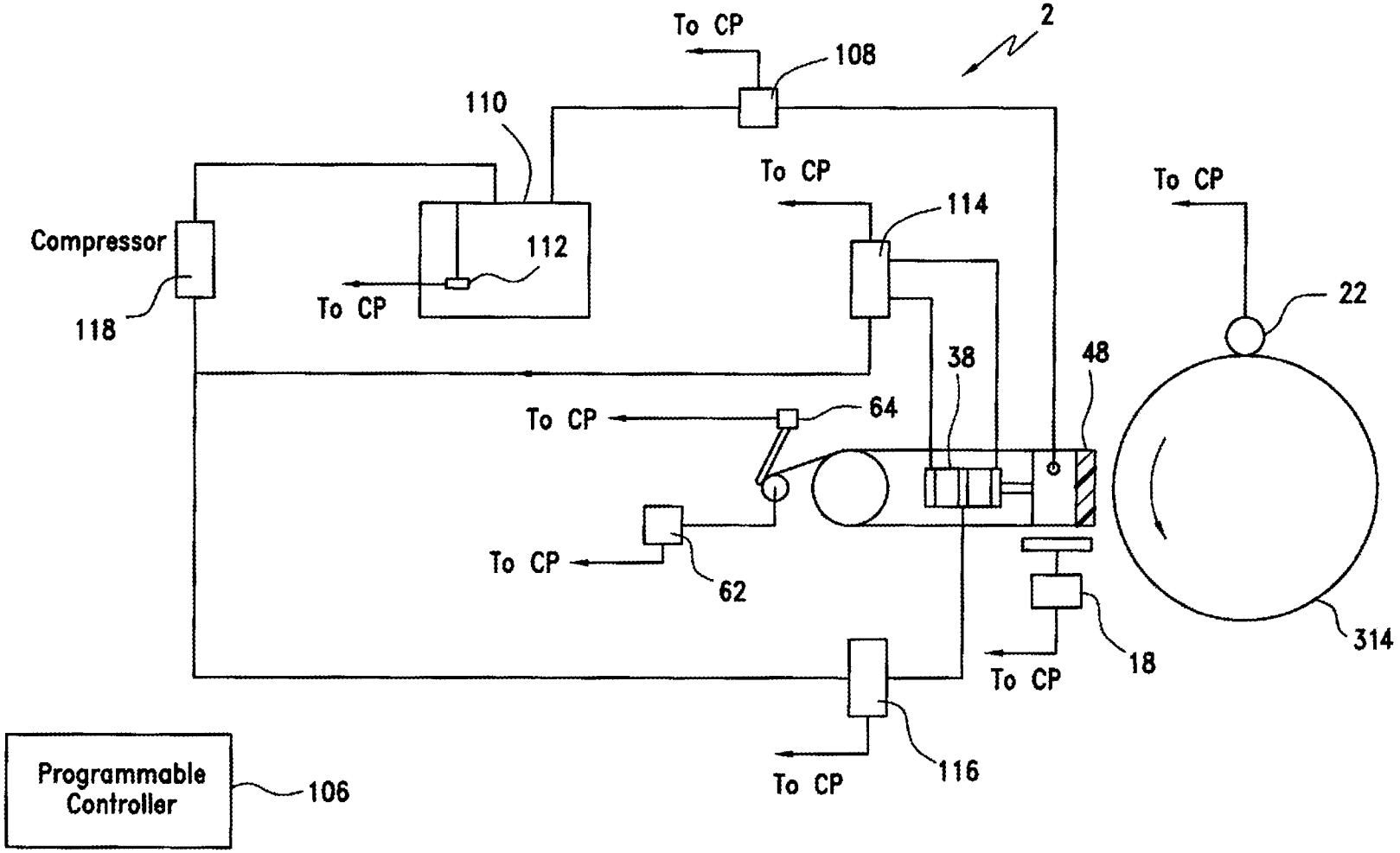
FIG. 9 is a schematic diagram of the interconnection of the various components of one embodiment of the cleaning apparatus.

Referring to FIG. 2, area 310 represents the surface of the cloth 58 in contact with the blanket roller 4. The arrow D indicates the cleaner 2 traverses a path back and forth on the surface of the blanket roller 4 while it is turning. The dashed area 310 above engraved roller 3 corresponds to the area of the cloth on the engraved roller 3. The cleaner 2 traverses a path back and forth on the surface of the engraved roller 3 while it is turning. It is optional for cleaner 2 to perform a dry clean operation on the engraved roller 3. The cleaner 2 will also perform a wet wipe while it strongly presses the cloth 58 against the indicia 9 and applies cleaning fluid to perform a wet wipe. In addition, bristles as shown in FIG. 8, further assist cleaning ink and debris from the engraved roller 3. The cleaner 2 may provide a final dry wipe before printing is resumed.

Figure 3:
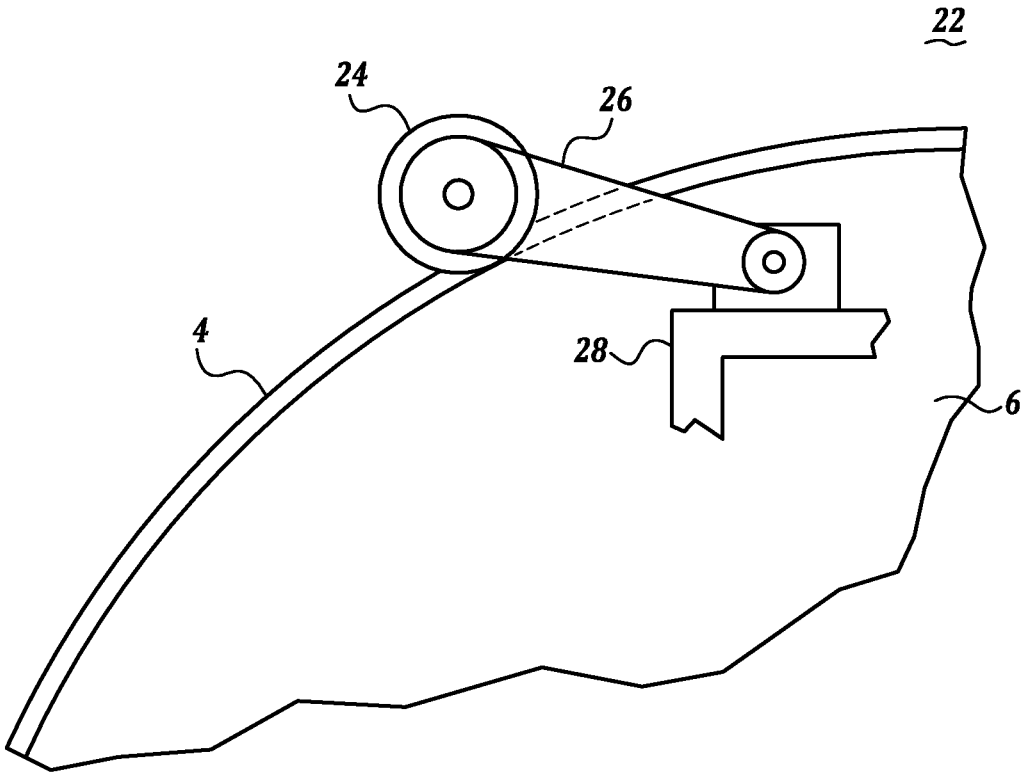
FIG. 3 is a schematic side view of a speed encoder for determining the speed of the blanket support roller.
Figure 12:
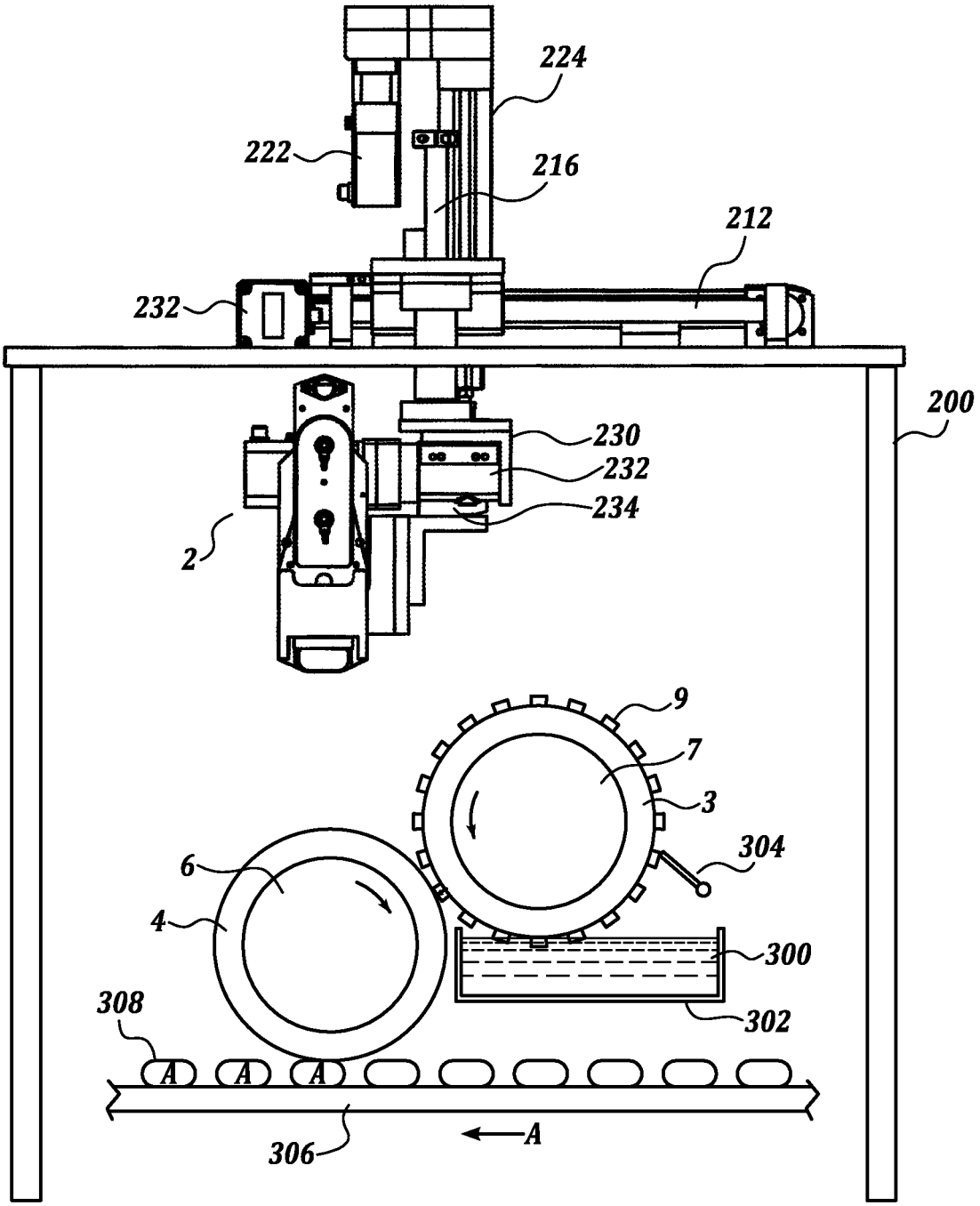
FIG. 12 is a side view of the table of FIG. 11 disposed over the engraved and blanket rollers of an offset printing press.

Referring to FIGS. 3 and 12, a speed encoder 22 has an encoder wheel 24 that provides rotational speed information to a motor 232 so that the traverse speed of the cleaner 2 across the blanket roller 4 may be adjusted automatically, depending on the rotational speed of the first support cylinder 6 so that the same amount of contact between the cleaner 2 and the blanket roller 4 is maintained regardless of the first support cylinder's speed. The encoder wheel 24 is mounted in a standard manner for rotational engagement with the first support cylinder by means of a pivot arm 26 mounted to a bracket 28.

Figure 4:
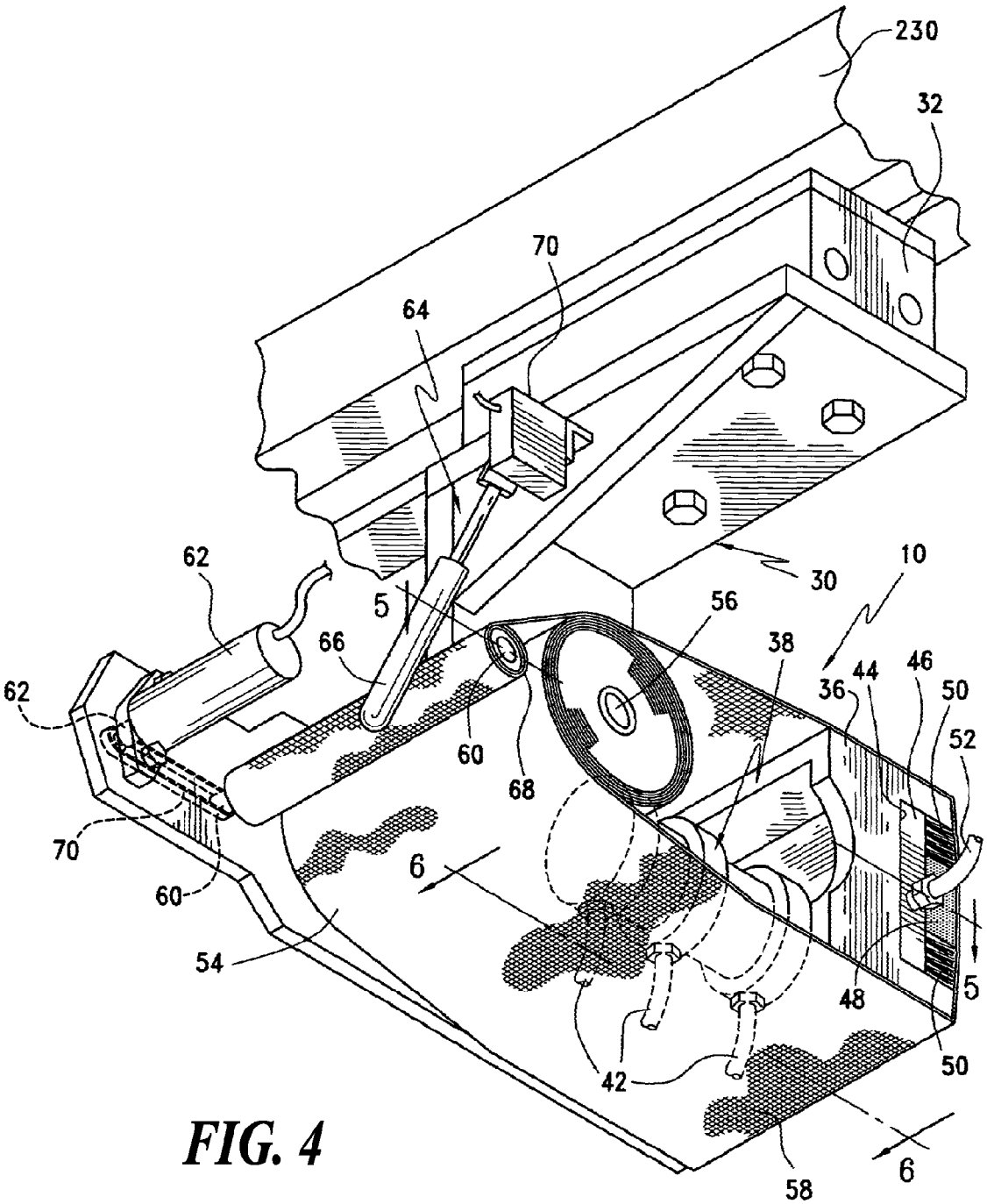
FIG. 4 is a bottom perspective view of a cleaning head made in accordance with one embodiment.

Referring to FIGS. 4 and 12, the cleaning head 10 comprises a frame 30 secured to a carrier block 32, which in turn is operably secured to the endless belt 234 within the actuator housing 230. It will be understood that as the belt 234 is actuated clockwise or counterclockwise by the motor 232 the cleaning head 10 will traverse left or right along a linear path parallel to the axis of rotation of the blanket roller 4 and the blanket support cylinder 6.

A base structure 36 is operably secured to the frame 30. A double-acting three-position cylinder 38 is attached to the base structure 36 in a standard manner, such as by bolts 40 shown in FIG. 5. Fluid hoses 42 communicate within the cylinder 38, as will be discussed below. A front portion of the base structure 36 includes a recess 44 in which a backing plate 46 is disposed. The backing plate 46 is operably secured to the cylinder 38 as will be discussed below. A sponge pad 48 and bristles 50 are operably secured to the backing plate 46. The backing plate 46 operates as a pressure plate to transmit pressure from the cylinder 38 to the sponge pad. A cleaning fluid inlet hose 52 communicates with a passageway within the backing plate 46 to deliver the cleaning fluid to the sponge pad 48. The sponge pad, in some embodiments, is an open cell polyurethane foam.

A roll 54 of cloth 58 is carried by an unwind spindle 56. The cloth 58 is coursed from the roll 54 to underneath, in front and on top of the base structure 36 and wound around a rewind spindle 60 driven by a motor 62. The rewind spindle 60 is driven by the motor 62 by conventional means such as belt 72, shown in dashed lines. A low cloth sensor 64 provides an alarm when the supply cloth roll 54 is nearly used up. The sensor 64 includes a pivoting arm 66 with one end in engagement with a used roll 68 and the other end being associated with a switch 70. As the used roll 68 increases in diameter, the arm 66 pivots radially, eventually activating the switch 70 to send an alarm to a controller when the used roll 68 reaches a certain diameter indicative of the cloth roll 54 being nearly used up. For some embodiments, the low cloth sensor 64 is further described in U.S. Pat. No. 5,519,914. In such embodiments, the cloth 58 is a highly absorbent "clean room" grade, 100% woven polyester linen available from Lymtech Scientific, Chicopee, Mass. under the designation Purity Wipes. However, other cloths including non-woven material may be used in alternate embodiments.

Figure 5:
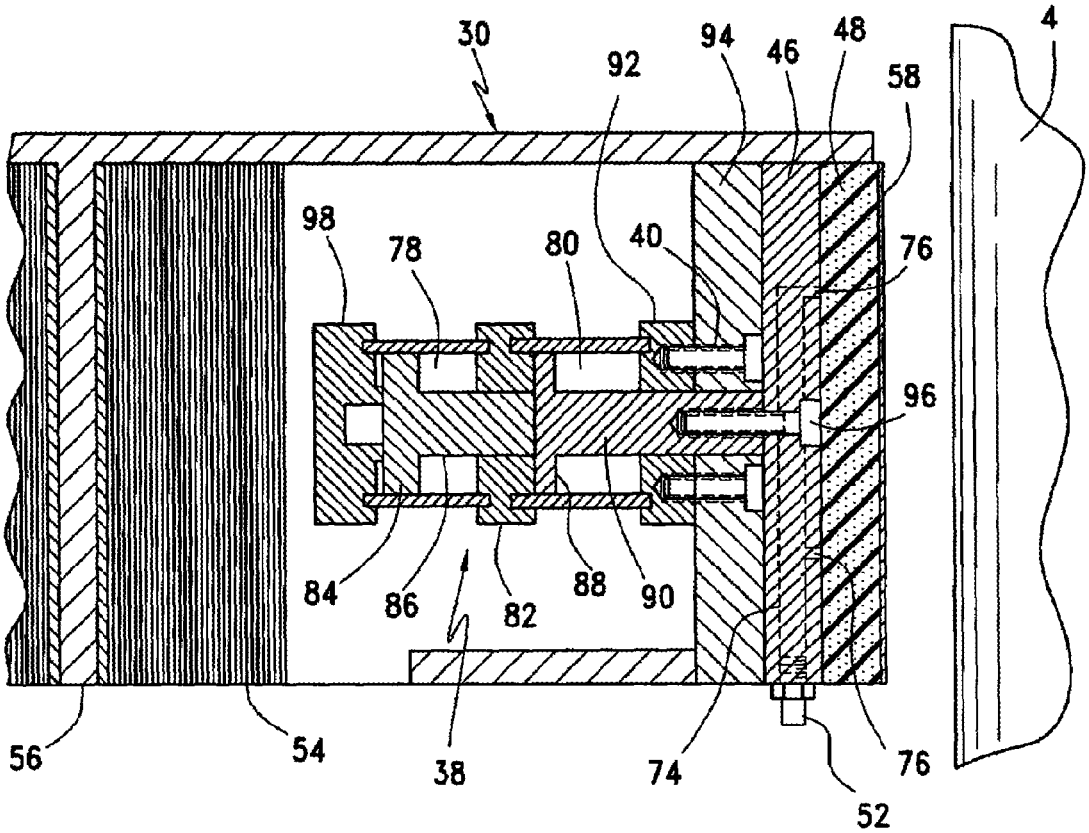
FIG. 5 is a cross-sectional view taken along line 5-5 of FIG. 4.

Referring to FIG. 5, the backing plate 46 includes a passageway 74 that communicates with the inlet hose 52 and outlet ports 76 to deliver the cleaning fluid from a reservoir to the sponge pad 48 and to the cloth 58. Since the sponge pad 48 is in direct contact with the cloth 58, the cleaning fluid in the sponge pad is absorbed by the cloth.

Figure 6:
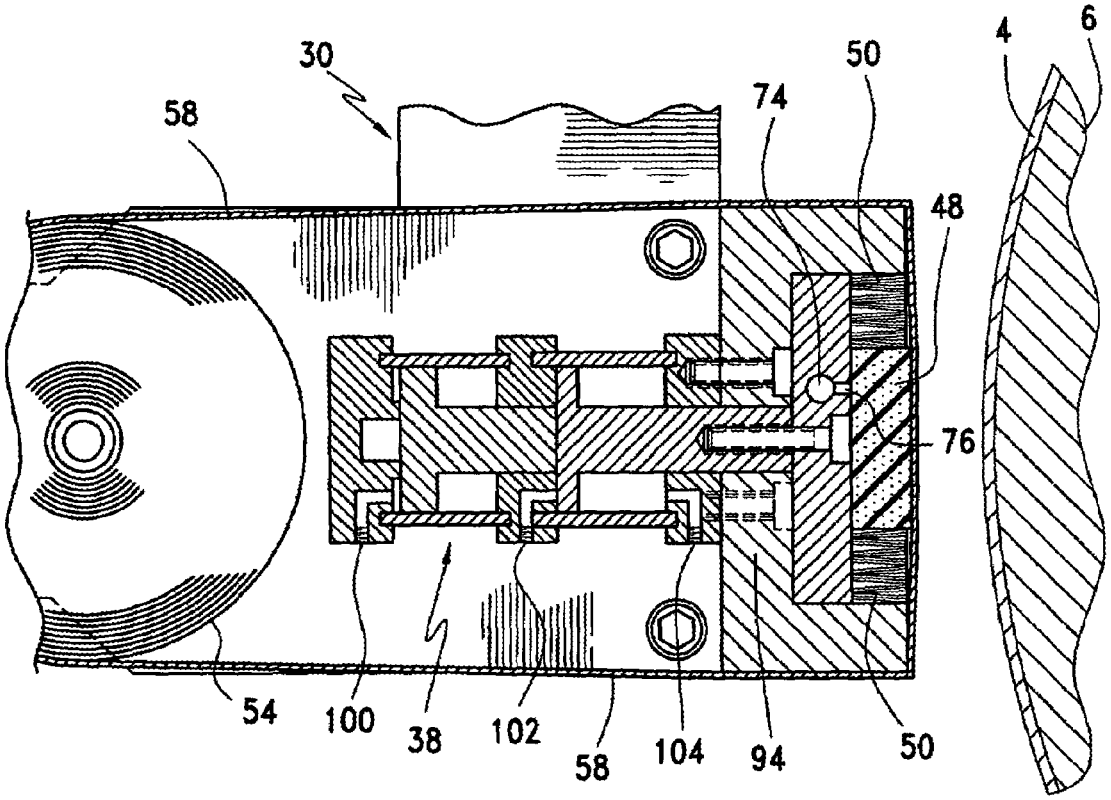
FIG. 6 is a cross-sectional view taken along line 6-6 of FIG. 4.

Referring to FIG. 6, the bristles 50 are disposed along the top and bottom edges of the sponge pad 48. The bristles 50 are slightly shorter than the thickness of the sponge pad 48.

The cylinder 38 comprises chambers 78 and 80 separated by a wall 82. A piston 84 with a piston rod 86 is disposed in the chamber 78. A piston 88 and its associated piston rod 90 are disposed within the chamber 80. The piston rod 86 extends through an opening in the wall 82 and engages the piston 88. The piston rod 90 extends through an opening through an end wall 92 and through an opening in a bottom wall 94 of the recess 44. A bolt 96 or other standard means secures the piston rod 90 to the backing plate 46. An end wall 98 encloses the chamber 78. Fluid inlet port 100 communicates with the chamber 78 and inlet ports 102 and 104 with the respective chamber 80, as best shown in FIG. 6.

Figure 7:
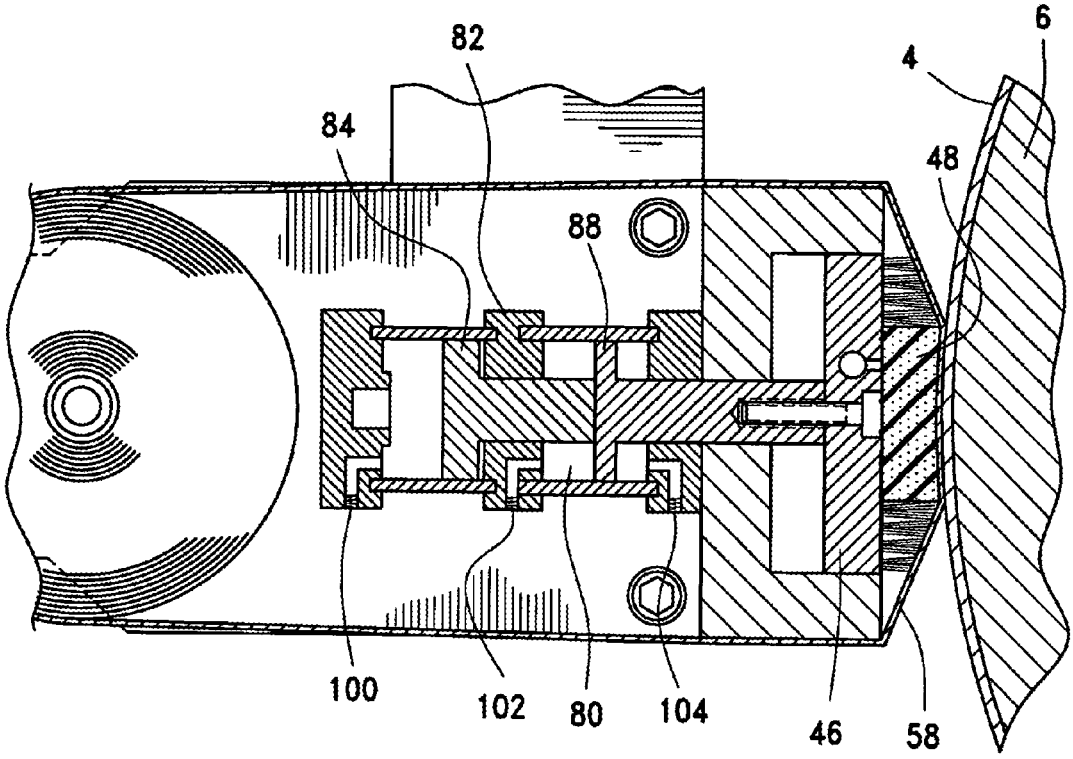
FIG. 7 is similar to FIG. 6, but showing the cylinder extended to an intermediate position.

The cylinder 38 has a fully retracted position, as shown in FIGS. 5 and 6, an intermediate extended position, as shown in FIG. 7 for dry cleaning either roller 3 or 4, and a fully extended position, as shown in FIG. 8 for wet cleaning engraved roller 3. In the retracted position, the pistons 84 and 88 are both retracted and the backing plate 46 is fully seated within the recess 44.

When pressurized fluid, such as compressed air, is supplied to fluid inlet port 100, the piston 84 moves to the wall 82, and pushes the piston 88 to an intermediate position within the chamber 80, thereby pushing the backing plate 46 partway toward the blanket roller 4, causing the cloth 58 to make contact with the blanket roller 4 with sufficient pressure to wipe the blanket roller 4 or the engraved roller 3 as it turns with the respective support cylinders 6, 7. At this position, called the dry wipe mode, a very low air pressure, for example less than 20 psi, allows the sponge pad 48 and the cloth 58 to float over the surface of the plate 4. The dry wipe mode allows the cloth to lightly collect ink from the blanket roller and debris (hickies) from the roller surfaces, and allows a light, dry and continuous wiping of each roller, resulting in greatly improved printing quality without stopping the press to handle the blanket roller and without any cleaning fluid.

To clean the engraved roller 3, the printing operation is interrupted and the cleaner 2 is repositioned to urge the web 58 of cleaning material against the engraved roller 3. It is optional to provide one or more initial dry wipes of the engraved roller 3 before making a wet wipe. After the initial dry wipes are finished, the cleaner operates in its wet wipe mode.

The cleaner 2 traverses the surface of the engraved roller 3 while the roller is turning. The cleaner 2 may clean the engraved roller 3 in a wipe mode or a wash mode. In the wipe mode, the pressure applied to the web 58 and the cleaning fluid supplied to the web are less than the wet wipe mode. In a further optional operation, the cleaner 2 may provide one or more dry wipe modes.

During the wash mode, pressurized fluid is supplied to the fluid inlet port 102, the piston 88 moves to the end wall 92 and causes the backing plate 46 to move further towards the engraved roller 3, thus further depressing the sponge pad 48 and causing the bristles 50 to protrude through the weave of the cloth 58 and make contact with the engraved roller 3 to provide thorough scrubbing of the contoured surface of the engraved roller 3. At this position, more aggressive cleaning is provided by the bristles whenever the press is not in production. During the wash mode, a higher pressure, for example 30 psi, is supplied to the inlet port 102 to allow a greater force to be applied to the backing plate 46, urging the bristles to make more forceful contact with the plate. A higher fluid flow rate is also provided to the sponge pad 48 to allow a more thorough washing of the engraved roller 3, which is done offline when printing is not being performed. The wash mode thoroughly soaks the sponge pad to assist with the removal of dried ink from the surface of the engraved roller 3. Separate liquid control is provided for the wet wipe mode compared to the wash mode.

The various components of the cleaner 2 are controlled from a programmable controller 106. The inlet hose 52 for the cleaning fluid is connected to a solenoid valve 108 which in turn is connected to a liquid pressure vessel 110 with a level sensor 112 connected to the controller 106. The inlet fluid port 110 of the cylinder 38 is connected to a solenoid valve 114. The fluid inlet port 102 is connected to another solenoid valve 116, set at a higher pressure than the valve 114. The valves 114 and 116 are controlled from the controller 106. A compressor 118 supplies compressed air to the pressure vessel 110 and to the cylinder 38.

Figure 10:
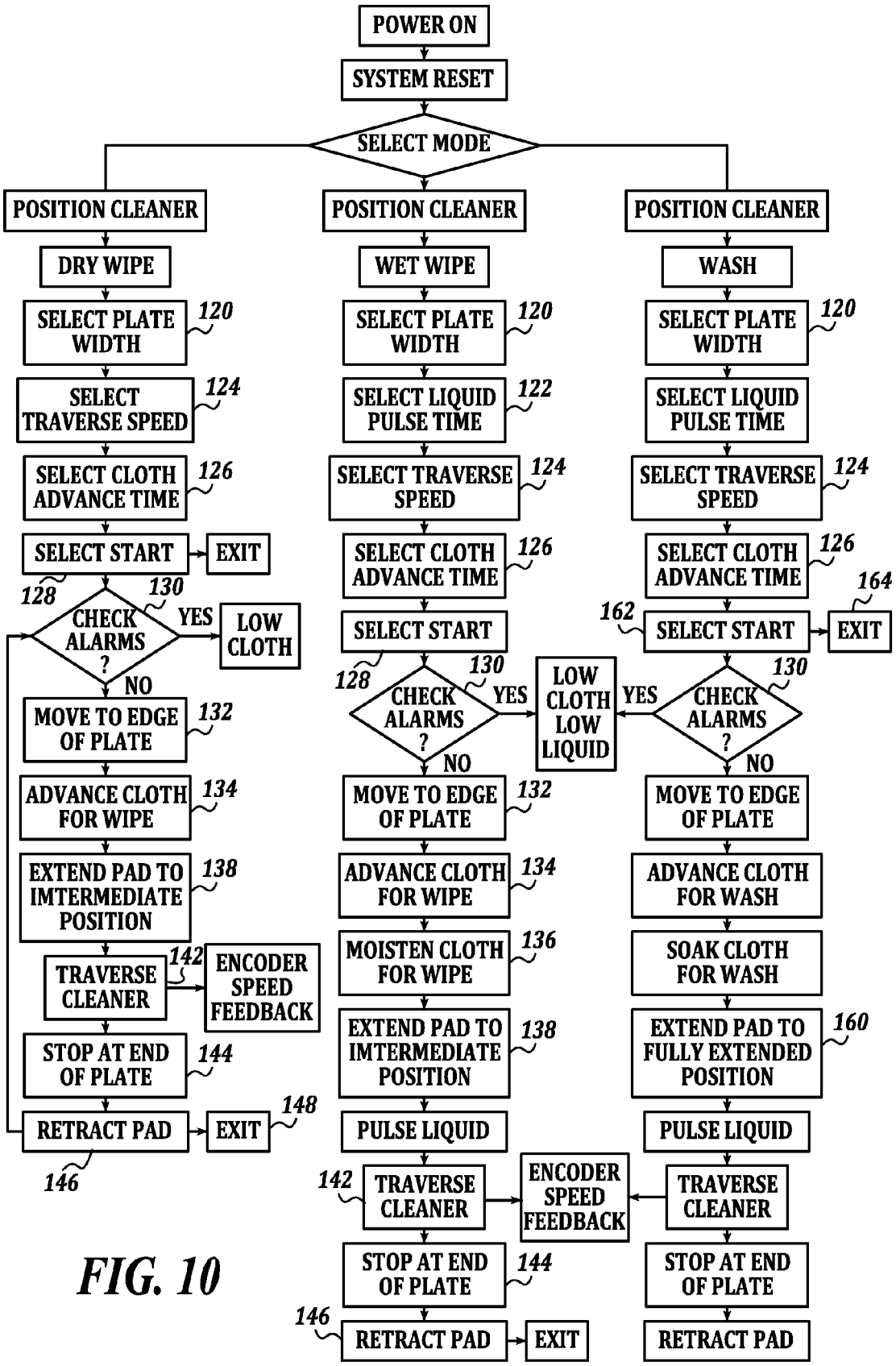
FIG. 10 is a flow chart showing the operation of one embodiment of the cleaning apparatus.

The operation of the cleaner 2 will now be described. Referring to FIG. 10, the cleaner 2 has three cleaning modes, namely the dry wipe mode, the wet wipe mode and the wash mode. The dry wipe mode is used to remove debris (hickies) on the blanket roller 4 while printing is ongoing. The wet wipe mode is used to gently clean the engraved roller 3 while printing is paused and the wash mode is used to vigorously wash and rinse the engraved roller 3 while the press is offline.

Under the dry wipe mode, the blanket roller width is selected at 120 to control the traverse distance of the cleaning head 10. The traverse speed for the cleaning head 10 across the blanket roller 4 is selected at 124. A cloth advance time is selected at 126 which determines the operation of the rewind motor 62 to draw a new, clean section of the cloth 58 over the sponge pad 48. After the cleaner 2 is started at 128, alarms are checked at 130 for "low cloth" from the sensor 64. The cleaning head 10 is then moved to the edge of the blanket roller 4 at 132, the cloth is advanced at the selected time at 134, and the sponge pad is extended to the intermediate position at 138 by operating the valve 114 to provide compressed air into the chamber 78. The cleaning head 10 then traverses the length of the blanket roller 4 at 142 while the traverse speed is adjusted based on the speed of the plate cylinder 6, as determined by the speed encoder 22. The cleaning head reverses direction at the end of the blanket roller 4 at 144 and dry cleans the roller as the cleaning head returns to the opposite end of the blanket roller 4. The cleaning head is then retracted at 146 by providing compressed air through the inlet port 104 into the chamber 80. The whole process may be repeated starting at 130 for as many times as desired until the operator exits at 148. In some embodiments, the dry wipe mode is set to cycle at predetermined times such as every ten minutes.

Prior to entering the wet wipe mode, the printing action is interrupted and the cleaner 2 is repositioned to be closely adjacent to the engraved roller 3. The engraved roller 3 is periodically cleaned less frequently than the blanket roller 4. In one embodiment, the engraved roller 3 is cleaned once every hour. During the wet wipe mode, the engraved roller 3 width is selected at 120 to control the traverse distance of the cleaning head 10. A liquid pulse time is selected at 122, which determines the amount of time the solenoid valve 108 is pulsed to inject the cleaning fluid to the sponge pad. The traverse speed for the cleaning head 10 across the engraved roller 3 is selected at 124. A cloth advance time is selected at 126 which determine the operation of the rewind motor 62 to draw a new, clean section of the cloth 58 over the sponge pad 48. After the cleaner 2 is started at 128, alarms are checked at 130 for "low cloth" from the sensor 64 or for a low liquid level from the sensor 112. The cleaning head 10 is then moved to the edge of the engraved roller 3 at 132, the cloth is advanced at the selected time at 134, the cloth is moistened at 136 by operating the valve 108 and the sponge pad is extended to the intermediate position at 138 by operating the valve 114 to provide compressed air into the chamber 78. The cleaning fluid is then pulsed at 140 by intermittently operating the valve 108, thereby injecting the cleaning fluid through the passageway 74 to the sponge pad 48. The cleaning head 10 then traverses the length of the engraved roller 3 at 142 while the traverse speed is adjusted based on the speed of the support cylinder 7, as determined by the speed encoder 22. The cleaning head is then stopped at the end of the engraved roller 3 at 144. The cleaning head is then retracted at 146 by providing compressed air through the inlet port 104 into the chamber 80. The whole process may be repeated starting at 130 for as many times as desired until the operator exits at 148.

The wash mode is similar to the wipe mode except that the cylinder 38 is extended to its fully extended position at 160. Each cycle can be repeated as many times as desired at 162 until the operator exits at 164.

In some embodiments, the engraved roller 3 is traversed one or more times in a dry wipe mode, followed by wet wipe mode, an optional wash mode, and concluded with one or more dry wipes.

Figure 11:
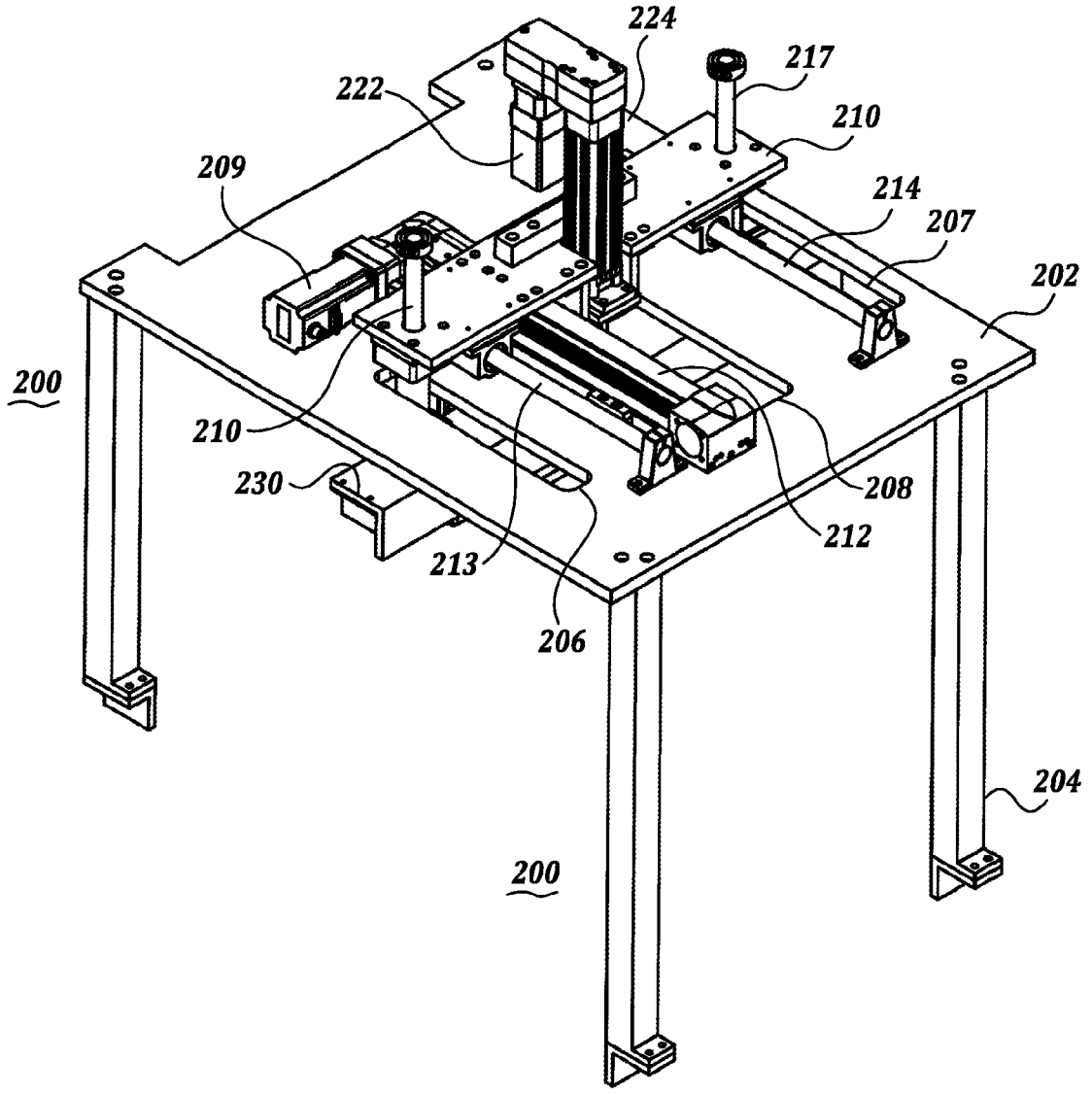
FIG. 11 is a perspective view of a table supporting the cleaning apparatus.

Turning to FIGS. 11 and 12, the cleaner 2 is supported below a table 200 in the actuator housing 230. The table has a top 202 and four legs 204. Table top 202 has two end openings 206, 207 and a central opening 208. A carriage plate 210 has vertical supports 216, 217 that extend through the end openings 206, 207 and hold a housing 230 that supports the cleaner 2. The openings 206, 207 allow the carriage plate 210 and vertical supports 216, 217 to move laterally within openings 206, 207. A motor 209 drives endless belt 212 to move the carriage plate 210 and the cleaner left and right as shown by arrow B of FIG. 1. Lateral guides 213, 214 hold the carriage plate 210 and the cleaner 2 in position perpendicular to the axes of the engraved roller 3 and the blanket roller 4.

A stepper motor 222 moves a screw drive 224 up and down in the directions of arrow C of FIG. 1. The bottom of the screw drive is coupled to the housing 230. The cleaner 2 is fixed to a support on the endless belt 234. The cleaner 2 is driven back and forth across the faces of the rollers 3, 4 by a motor 232 connected to an endless belt 234 that is also supported by the housing 230. The conveyor belt 306 moves the objects 308 in the direction of arrow A so that the image of letter "A" on the surface of the of blanket (print) roller 4 contacts and is printed on the objects.

Other embodiments of the cleaner may use fewer electronic controls and permit manual setting of travel piston pressure and liquid volumes. For example, where a user operates embodiments to apply a single mark, letter, or a combination of letters and numbers to a candy, tablet, lozenge or troche, the blanket (print) roller may be only 2-3 feet long and could be operated mostly manually with the operator setting minimal values such as the travel of the cleaner, the pressure of the backing plate and the volume of the cleaning fluid.

Other embodiments of the cleaner may be used to clean small, three dimensional objects of virtually any shape including simply shaped items with opposite flat surfaces spaced from each other by a uniform thickness or other shapes including top and bottom surfaces of any polygon as well as top and bottoms with opposite curved surfaces to form a sphere, an ovoid or other multi-curved shapes. Still other embodiments may be used with general purpose offset printing presses to clean rollers that print on surfaces of thin or thick substrates, including and not limited to paper, cardboard, and sheets of plastic.

In some embodiments, the pressure applied during dry cleaning the engraved roller is the same pressure applied while cleaning the blanket roller. In other embodiments, the pressure may be different, including more or less than the pressure applied to the blanket roller. In some embodiments, the pressure applied during the wet, wipe mode may be the same as the pressure applied during the dry cleaning mode, more pressure, or less pressure.

While preferred embodiments of the invention have been shown and described, modifications and variations may be made thereto by those of ordinary skill in the art without departing from the spirit and scope of the present invention. In addition, it should be understood that aspects of the various embodiments may be interchanged either in whole or in part. Furthermore, those of ordinary skill in the art will appreciate that the foregoing description is by way of example only, and is not intended to be limitative of the invention as further described in the appended claims. Those skilled in the art understand that other and equivalent components and steps may be used to achieve substantially the same results in substantially the same way as described and claimed.

The embodiments of the invention in which an exclusive property or privilege is claimed are defined as follows:

1. A cleaning apparatus for cleaning a printing press, comprising:

a moveable frame for traversing a path parallel to the axis of an engraved roller or a blanket roller;

means for positioning the moveable frame proximate one of the rollers for performing one cleaning operation on the one roller and means for placing the moveable frame proximate the other roller for performing another cleaning operation on the other roller;

at least one unwind spindle rotatably attached to the frame, the unwind spindle having an axis of rotation substantially parallel to the pair or rollers, the unwind spindle holding a rolled web of dry absorbent cleaning material for absorbing wet ink and for turning to dispense new dry cleaning material;

at least one rewind spindle for turning to roll up the web of cleaning material, the rewind spindle being rotatably attached to the frame and having an axis of rotation substantially parallel to the pair or rollers;

a spindle motor attached to the frame and coupled to one or both spindles to turn the spindles and thereby dispense new dry cleaning material and rewind used cleaning material;

a multiposition motor carried by the frame, the motor including a first rod having a retracted position, a first extended position and second extended position;

a backing plate secured to an exterior end of the first piston rod and movable with said first piston rod; and a cleaning pad disposed in front of the backing plate, engaging the web of cleaning material, and pressing the web against the blanket roller at a first pressure when the piston is in the first extended position to dry wipe the blanket roller while the frame traverses the blanket roller and for engaging the web of cleaning material and pressing the web against the engraved roller at a second pressure when the piston is in the second extended position to wet wipe the engraved roller while the frame traverses the engraved roller.

2. The cleaning apparatus of claim 1 wherein the means for positioning the frame proximate the rollers includes a table supporting first and second motors, the first motor coupled to the table and the frame for positioning the frame along a first axis transverse with respect to axes of the rollers and the second motor coupled to the table and the frame for positioning the frame along a second axis transverse to the first axis and to the axes of the rollers.

3. The cleaning apparatus of claim 1 wherein a linear actuator coupled to the frame moves the frame along a path parallel to the axes of the rollers.

4. The cleaning apparatus of claim 3 wherein the linear actuator is further coupled to the table.

5. The cleaning apparatus of claim 3 wherein the linear actuator is further coupled to a printing press carrying the rollers.

6. The cleaning apparatus of claim 1 wherein the cleaning material further comprises web of dry absorbent cloth having a first end and a second end wherein the dry absorbent cleaning cloth is configured to attach to the unwind spindle at the first end and the rewind spindle at the second end.

7. The cleaning apparatus of claim 1 wherein the pad base includes thermoplastic polycarbonate resin material.

8. The cleaning apparatus of claim 1 wherein the pad comprises a resilient, absorbent material.

9. The cleaning apparatus of claim 8 wherein the resilient, absorbent material is an open cell polyurethane polymer material.

10. The cleaning apparatus of claim 1 wherein the cleaning pad is a cloth material; and a sponge pad is disposed behind said cloth material.

11. The cleaning apparatus of claim 1 wherein the cleaning pad is a cloth material and bristles are disposed behind said cloth material.

12. The cleaning apparatus of claim 11 wherein the bristles are adapted to protrude through said cloth material when said first piston rod is at said second position.

13. The cleaning apparatus of claim 1 wherein the unwind spindle further includes a first end disposed toward the frame wherein the first end includes a gear having a plurality of teeth wherein the gear is configured to be engaged by the spindle motor.

14. The cleaning apparatus of claim 1, further comprising means for determining the rotational speed of the unwind spindle selected from the group consisting of a proximity sensor configured to transmit a signal representing a specific of number of teeth and a mechanical switch.

15. The cleaning apparatus of claim 1 wherein the multiposition motor is a double action linear motor selected from the group consisting of an electric motor, an electromechanical motor, a piezoelectric motor, an electric stepper motor, a hydraulic motor, a servo motor, and a pneumatic motor.

16. The cleaning apparatus of claim 1 wherein the multiposition motor comprises a three-position cylinder having first and second chamber having respective first and second bottom walls and first and second top walls; first and second pistons disposed with respective first and second chambers; said first piston rod and a second piston rod are secured to respective first and second pistons; said first and second pistons are disposed against said respective first and second bottom walls when said three-stroke cylinder is in said retracted position; said second piston rod is configured to push said first piston when said second piston is actuated to engage against said second top wall to bring said first piston rod to said first extended position; said first chamber is configured such that said first piston is disposed intermediate said first bottom and top walls when in said first extended position; said first rod is a first piston rod and moves to said second extended position when said first piston is actuated to engage against said first top wall; and said first piston is configured to push said second piston against said second bottom wall when said first piston is actuated toward said first bottom wall to assume said retracted position.

17. The cleaning apparatus of claim 16 wherein the second bottom wall includes a second fluid port to actuate said second piston to said second top wall; the first bottom wall includes a first fluid port to actuate said first piston to said first top wall; and the top wall includes a third fluid port to actuate said first piston to said first bottom wall.

18. The cleaning apparatus of claim 1, further comprising a low-cloth sensor.

* * * * *